US011503964B2

(12) United States Patent
Roden, II

(10) Patent No.: US 11,503,964 B2
(45) Date of Patent: Nov. 22, 2022

(54) CUSTOMIZABLE CLEANING BRUSH

(71) Applicant: Reginald Roden, II, Warrior, AL (US)

(72) Inventor: Reginald Roden, II, Warrior, AL (US)

( * ) Notice: Subject to any disclaimer, the term of this patent is extended or adjusted under 35 U.S.C. 154(b) by 231 days.

(21) Appl. No.: 16/903,864

(22) Filed: Jun. 17, 2020

(65) Prior Publication Data

US 2021/0393088 A1 Dec. 23, 2021

(51) Int. Cl.

| | |
|---|---|
| ***A47K 7/04*** | (2006.01) |
| ***A46B 9/00*** | (2006.01) |
| ***A46B 5/00*** | (2006.01) |
| ***A46B 13/02*** | (2006.01) |
| ***A46B 15/00*** | (2006.01) |
| ***A46B 7/04*** | (2006.01) |
| ***A46B 13/00*** | (2006.01) |
| ***A61H 7/00*** | (2006.01) |
| ***A61H 23/02*** | (2006.01) |

(52) U.S. Cl.

CPC ..... *A47K 7/04* (2013.01); *A46B 5/0012* (2013.01); *A46B 5/0079* (2013.01); *A46B 5/0095* (2013.01); *A46B 7/04* (2013.01); *A46B 9/005* (2013.01); *A46B 13/008* (2013.01); *A46B 13/023* (2013.01); *A46B 15/0012* (2013.01); *A46B 15/0044* (2013.01); *A46B 15/0051* (2013.01); *A61H 7/005* (2013.01); *A61H 23/02* (2013.01); *A46B 2200/1006* (2013.01); *A61H 2201/1215* (2013.01); *A61H 2201/1666* (2013.01); *A61H 2201/1671* (2013.01); *A61H 2201/1685* (2013.01); *A61H 2201/5025* (2013.01)

(58) Field of Classification Search

CPC ..... A47K 7/04; A46B 5/0012; A46B 5/0079; A46B 5/0095; A46B 7/04; A46B 13/008; A46B 13/023; A46B 15/002

See application file for complete search history.

(56) References Cited

U.S. PATENT DOCUMENTS

2016/0120375 A1* 5/2016 Philips ..... A61H 23/0263 15/22.1

FOREIGN PATENT DOCUMENTS

| | | | | |
|---|---|---|---|---|
| CN | 211723915 U | * | 10/2020 | |
| CN | 212138863 U | * | 12/2020 | |
| WO | WO-2016184395 A2 | * | 11/2016 | ..... A46B 15/0012 |

* cited by examiner

*Primary Examiner* — Shay Karls

(74) *Attorney, Agent, or Firm* — The Iwashko Law Firm, PLLC; Lev Ivan Gabriel Iwashko

(57) ABSTRACT

A customizable cleaning brush, including a main body, a plurality of head members removably connected to at least a portion of the main body to brush, scrub, and massage a body of a user, a plurality of operation controls disposed on at least a portion of a first side of the main body to perform at least one of a rotation, oscillation, and vibration of the plurality of head members, and a plurality of pressure controls disposed on at least a portion of a second side of the main body to perform at least one of a speed control and a pressure control of the plurality of head members.

7 Claims, 2 Drawing Sheets

CUSTOMIZABLE CLEANING BRUSH

BACKGROUND

1. Field

The present general inventive concept relates generally to a brush, and particularly, to a customizable cleaning brush.

2. Description of the Related Art

Many people take a bath and/or a shower to have a presentable appearance in public and for personal hygiene. However, attempting to wash and/or scrub particular areas on a body of a person, such as a back of the person using a cloth and/or a shower brush is difficult.

Moreover, a typical brush is limited in length and/or has bristles in a fixed position. Also, the bristles tend to be static, such that a user has to move the brush to move the bristles against the body of the user. As such, the typical brush depends on an ability of the user to move an arm in a position to facilitate scrubbing and/or massaging.

Therefore, there is a need for a customizable cleaning brush that is capable of reaching any part of the body of the user.

SUMMARY

The present general inventive concept provides a customizable cleaning brush.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a customizable cleaning brush, including a main body, a plurality of head members removably connected to at least a portion of the main body to brush, scrub, and massage a body of a user, a plurality of operation controls disposed on at least a portion of a first side of the main body to perform at least one of a rotation, oscillation, and vibration of the plurality of head members, and a plurality of pressure controls disposed on at least a portion of a second side of the main body to perform at least one of a speed control and a pressure control of the plurality of head members.

Each of the plurality of head members may be at least one of bristles, sponges, and massaging members.

The customizable cleaning brush may further include a handle disposed on at least a portion of a first end of the main body to facilitate gripping thereof.

The handle may extend telescopically and at least partially deform.

The customizable cleaning brush may further include an eject button disposed on at least a portion of a second end of the main body to extract the plurality of head members in response to depressing the eject button.

The customizable cleaning brush may further include an air dispersion unit disposed on at least a portion of the main body to blow air towards each of the plurality of head members for a predetermined period of time in response to turning off the plurality of head members.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Figure 1:
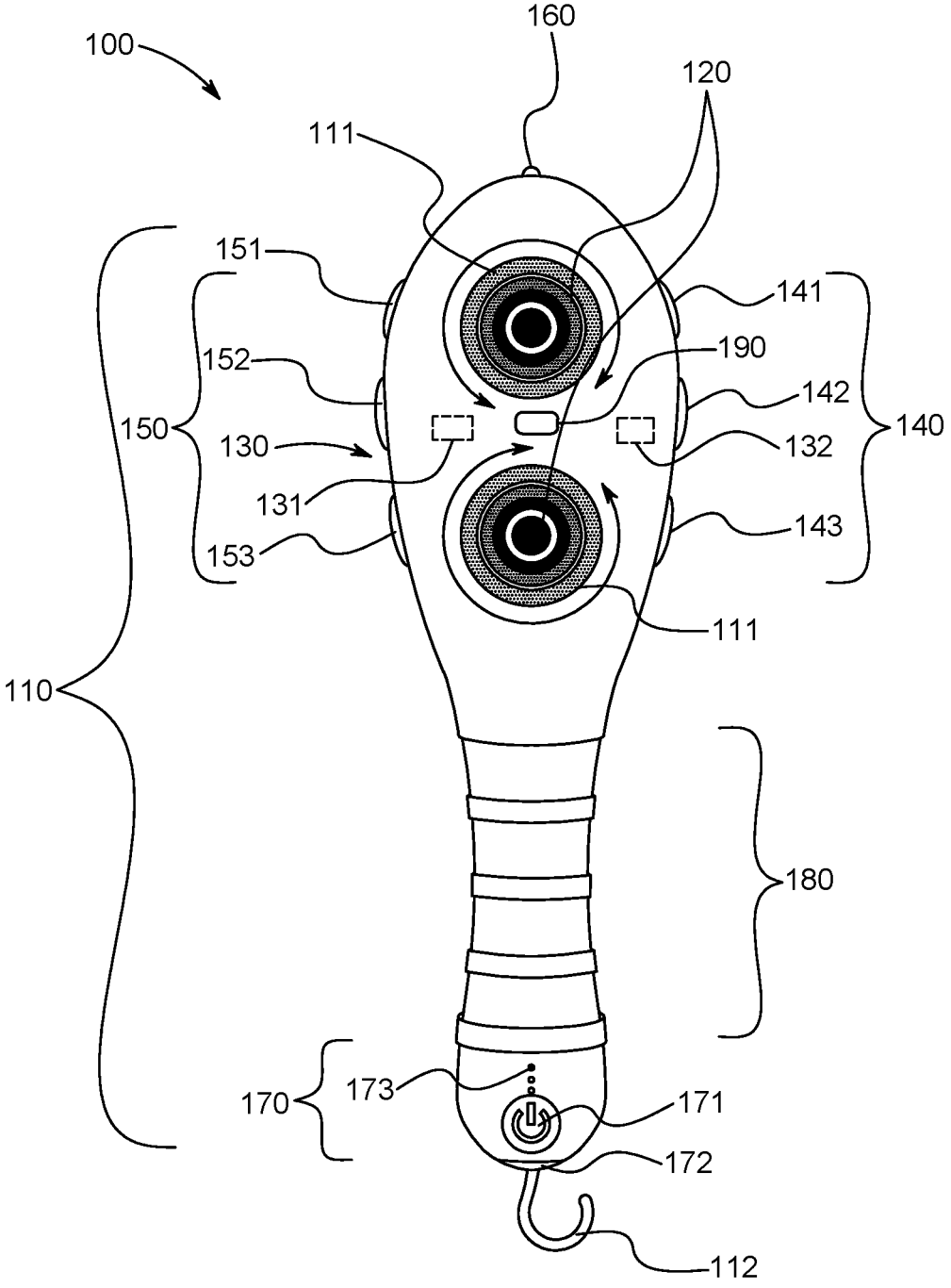
FIG. 1 illustrates a front view of a customizable cleaning brush, according to an exemplary embodiment of the present general inventive concept.

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Customizable Cleaning Brush 100
Main Body 110

Member Receiving Portions 111
Hook 112
Head Members 120
Motors 130
Rotating Motor 131
Vibrating Motor 132
Operation Controls 140
Rotation Button 141
Oscillation Button 142
Vibration Button 143
Pressure Controls 150
Smooth Button 151
Medium Button 152
Coarse Button 153
Eject Button 160
Power Unit 170
Power Button 171
Power Source 172
Power Indicator Lights 173
Handle 180
Air Dispersion Unit 190

FIG. 1 illustrates a front view of a customizable cleaning brush 100, according to an exemplary embodiment of the present general inventive concept.

Figure 2:
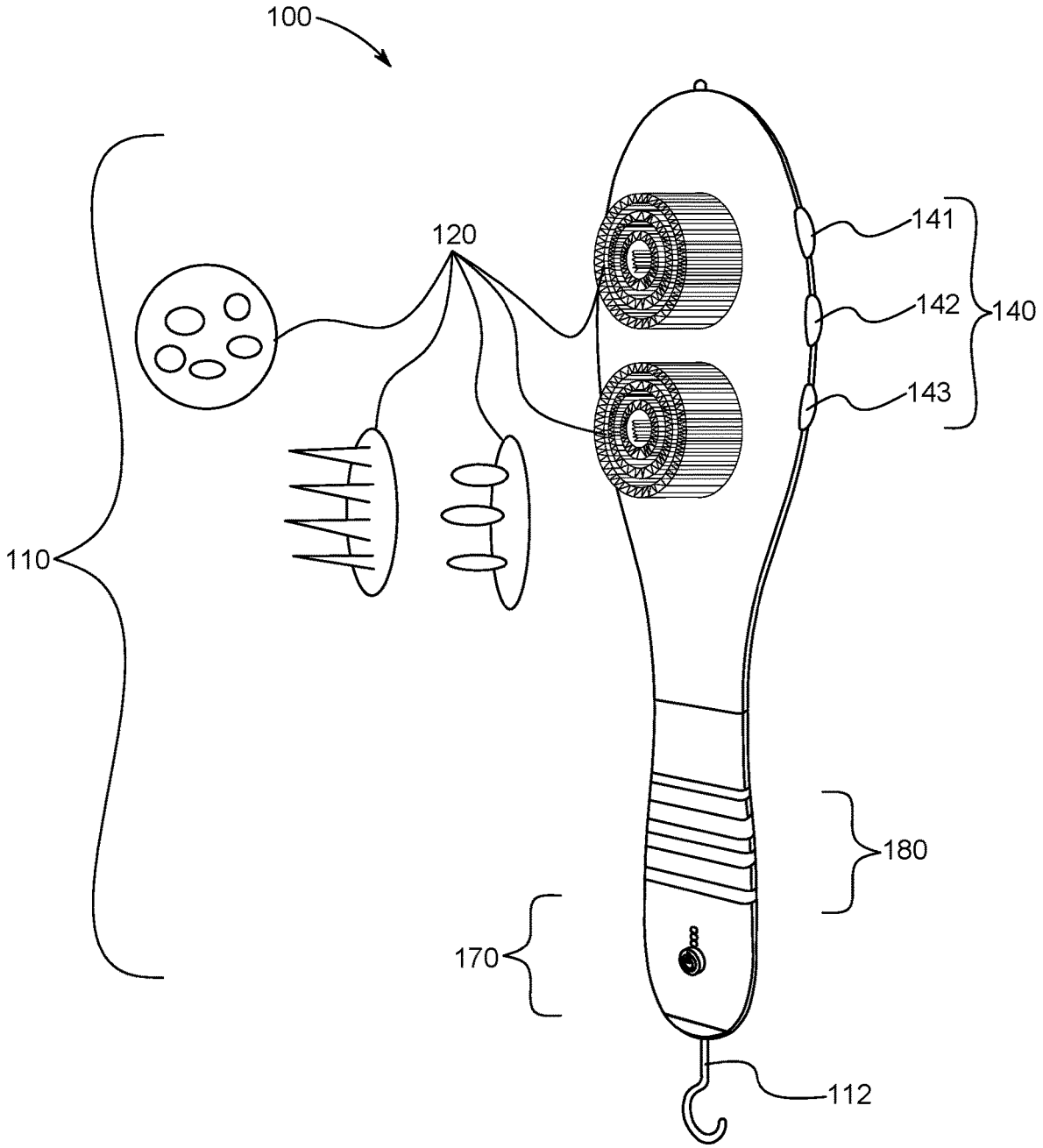
FIG. 2 illustrates a side perspective view of the customizable cleaning brush, according to an exemplary embodiment of the present general inventive concept.

FIG. 2 illustrates a side perspective view of the customizable cleaning brush 100, according to an exemplary embodiment of the present general inventive concept.

The customizable cleaning brush 100 may be constructed from at least one of metal, plastic, wood, ceramic, and rubber, etc., but is not limited thereto. Also, the customizable cleaning brush 100 may be waterproof.

The customizable cleaning brush 100 may include a main body 110, a plurality of head members 120, a plurality of motors 130, a plurality of operation controls 140, a plurality of pressure controls 150, an eject button 160, a power unit 170, a handle 180, and an air dispersion unit 190, but is not limited thereto.

The main body 110 may be constructed to be firm and/or flexible at different portions thereof. In other words, the main body 110 may resist movement (i.e. bending) in response to being applied against a body of a user. Alternatively, the main body 110 may at least partially deform (i.e. bend) in response to being applied against the body of the user. Furthermore, the main body 110 may have a predetermined length. For example, the length of the main body 110 may be between 6 and 7 inches. However, the predetermined length of the main body 110 may be based on a preference of the user.

The main body 110 may include a plurality of member receiving portions 111 and a hook 112, but is not limited thereto.

The plurality of member receiving portions 111 may be disposed on at least a portion of the main body 110.

The hook 112 may be disposed a first end (i.e. a base) of the main body 110. The hook 112 may allow the main body 110 to be disposed on a rack. In other words, the main body 110 may suspend from the rack via the hook 112. As such, the main body 110 may be stored on the rack using the hook 112.

Each of the plurality of head members 120 may include bristles, sponges, and massaging heads, but is not limited thereto.

Moreover, the bristles of the plurality of head members 120 may be firm and/or soft. In other words, at least a portion of the bristles of the plurality of head members 120 may be firm and/or at least another portion of the bristles of the plurality of head members 120 may be soft. As such, the bristles being firm may be more resistant to bending and/or feel coarser (i.e. rough) compared to the bristles being soft.

The sponges of the plurality of head members 120 may be firm and/or soft. In other words, at least a portion of the sponges of the plurality of head members 120 may be firm and/or at least another portion of the sponges of the plurality of head members 120 may be soft. As such, the sponges being firm may be more resistant to deforming and/or feel coarser compared to the sponges being soft.

The massaging heads may include rounded surfaces and/or spiked surfaces, but is not limited thereto. As such, the massaging heads may depend on the preference of the user.

The massaging heads of the plurality of head members 120 may be firm and/or soft. In other words, at least a portion of the massaging heads of the plurality of head members 120 may be firm and/or at least another portion of the massaging heads of the plurality of head members 120 may be soft. As such, the massaging heads being firm may be more resistant to deforming and/or feel coarser compared to the massaging heads being soft.

Each of the plurality of head members 120 may be removably connected to at least one of the plurality of member receiving portions 111. As such, each of the plurality of head members 120 may be any combination of bristles, sponges, and/or massaging heads. The plurality of head members 120 may brush, scrub, and/or massage at least a portion of the body of the user.

The plurality of motors 130 may include at least one rotating motor 131 and at least one vibrating motor 132, but is not limited thereto.

The at least one rotating motor 131 and/or the at least one vibrating motor 132 may be disposed within at least a portion of the main body 110.

Each of the plurality of head members 120 may rotate clockwise in a first direction or counterclockwise in a second direction in response to rotation of the at least one rotating motor 131. Alternatively, each of the plurality of head members 120 may oscillate in response to alternating rotations of the at least one rotating motor 131. In other words, the at least one rotating motor 131 may rotate in the first direction and/or subsequently, the second direction to oscillate.

Additionally, each of the plurality of head members 120 may vibrate in response to movement of the at least one vibrating motor 132.

The plurality of operation controls 140 may include a rotation button 141, an oscillation button 142, and a vibration button 143, but is not limited thereto.

Referring to FIGS. 1 and 2, the rotation button 141 may be disposed on at least a portion of a first side of the main body 110. The at least one rotating motor 131 may rotate in response to depressing the rotation button 141.

Referring again to FIGS. 1 and 2, the oscillation button 142 may be disposed on at least a portion of the first side of the main body 110. The at least one rotating motor 131 may oscillate in response to depressing the oscillation button 142.

Referring again to FIGS. 1 and 2, the vibration button 143 may be disposed on at least a portion of the first side of the main body 110. The at least one vibrating motor 132 may vibrate in response to depressing the vibration button 143.

The plurality of pressure controls 150 may include a smooth button 151, a medium button 152, and a coarse button 153, but is not limited thereto.

Specifically, the plurality of pressure controls 150 operate as a speed control during activation of the at least one rotating motor 131, and operate as a pressure control during activation of the at least one vibrating motor 132. Accordingly, the plurality of head members 120 may move corresponding to a speed and/or a pressure of the at least one rotating motor 131 and/or the at least one vibrating motor 132, respectively.

Referring again to FIGS. 1 and 2, the smooth button 151 may be disposed on at least a portion of a second side of the main body 110. The at least one rotating motor 131 and/or the at least one vibrating motor 132 may move at a slow speed and/or a smooth pressure, respectively, in response to depressing the smooth button 151. In other words, the at least one rotating motor 131 may rotate slowly and/or the at least one vibrating motor 132 may apply smooth (i.e. gentle) pressure to the user.

Referring again to FIGS. 1 and 2, the medium button 152 may be disposed on at least a portion of the second side of the main body 110. The at least one rotating motor 131 and/or the at least one vibrating motor 132 may move at a medium speed and/or a medium pressure, respectively, in response to depressing the medium button 152. Additionally, the medium speed and/or the medium pressure may be greater than the slow speed and/or the smooth pressure. In other words, the at least one rotating motor 131 may rotate at the medium speed and/or the at least one vibrating motor 132 may apply medium (i.e. intermediate) pressure to the user.

Referring again to FIGS. 1 and 2, the coarse button 153 may be disposed on at least a portion of the second side of the main body 110. The at least one rotating motor 131 and/or the at least one vibrating motor 132 may move at a fast speed and/or a coarse pressure, respectively, in response to depressing the coarse button 153. Additionally, the fast speed and/or the coarse pressure may be greater than the medium speed and/or the medium pressure. In other words, the at least one rotating motor 131 may rotate at the fast speed and/or the at least one vibrating motor 132 may apply coarse (i.e. strong) pressure to the user.

The eject button 160 may be disposed on at least a portion of a second end (i.e. a top) of the main body 110. The eject button 160 may extract the plurality of head members 120 in response to depressing the eject button 160. Therefore, at least one of the plurality of head members 120 may be exchange for at least one other head member 120. For example, at least one of the bristles may be exchanged for at least one of the sponges.

Alternatively, the eject button 160 may be a plurality of eject buttons 160, such that each of the plurality of eject buttons 160 may correspond to at least one of the plurality of member receiving portions 111.

The power unit 170 may include a power button 170, a power source 172, and a plurality of power indicator lights 173, but is not limited thereto.

The power unit 170 may be disposed on at least a portion of the first end of the main body 110. The power button 171 may turn on and/or turn off the plurality of motors 130, the plurality of operation controls 140, and/or the plurality of pressure controls 150.

The power source 172 may include a battery and a solar cell, but is not limited thereto.

The solar cell may recharge the battery in response to receiving power from an external light source. The power source 172 may send power to the plurality of motors 130, the plurality of operation controls 140, and/or the plurality of pressure controls 150.

The plurality of power indicator lights 173 may illuminate to indicate a power level of the power source 172. For example, illumination of all of the plurality of power indicator lights 173 may indicate the power source 172 is operating at full capacity. Illumination of less than all, but more than one may indicate partial capacity. Lastly, illumination of only one of the plurality of power indicator lights 173 may indicate the power source 173 is operating a low capacity and needs recharging.

The handle 180 may be disposed on at least a portion of the first end of the main body 110. The handle 180 may facilitate gripping thereof. Additionally, the handle 180 may extend telescopically and be flexible. As such, the handle 180 may extend the length of the main body 110 to accommodate the preference of the user. Additionally, the handle 180 may at least partially deform (i.e. bend) to orient the main body 110 in a different position based on the preference of the user. Therefore, the main body 110 may be adjusted to the different position to facilitate brushing, scrubbing, and/or massaging the user.

The air dispersion unit 190 may include a fan and a vacuum, but is not limited thereto.

The air dispersion unit 190 may be disposed on at least a portion of the second end of the main body 110. The air dispersion unit 190 may blow air towards each of the plurality of head members 120, such that the plurality of head members 120 receive air thereupon. Alternatively, the air dispersion unit 190 may extract air away from each of the plurality of head members 120.

Therefore, the air dispersion unit 190 may dry the plurality of head members 120. The air dispersion unit 190 may turn on for a predetermined period of time after depressing the power button 171, and automatically turn off after the predetermined period of time.

Furthermore, the air dispersion unit 190 may receive power from the power source 172.

Therefore, the customizable cleaning brush 100 may reach any part of the body of the user. Also, the customizable cleaning brush 100 may be customized using the plurality of head members 120.

The present general inventive concept may include a customizable cleaning brush 100, including a main body 110, a plurality of head members 120 removably connected to at least a portion of the main body 110 to brush, scrub, and massage a body of a user, a plurality of operation controls 140 disposed on at least a portion of a first side of the main body 110 to perform at least one of a rotation, oscillation, and vibration of the plurality of head members 120, and a plurality of pressure controls 150 disposed on at least a portion of a second side of the main body 110 to perform at least one of a speed control and a pressure control of the plurality of head members 120.

Each of the plurality of head members 120 may be at least one of bristles, sponges, and massaging members.

The customizable cleaning brush 100 may further include a handle 180 disposed on at least a portion of a first end of the main body 110 to facilitate gripping thereof.

The handle 180 may extend telescopically and at least partially deform.

The customizable cleaning brush 100 may further include an eject button 160 disposed on at least a portion of a second end of the main body 110 to extract the plurality of head members 120 in response to depressing the eject button 160.

The customizable cleaning brush 100 may further include an air dispersion unit 190 disposed on at least a portion of the main body 110 to blow air towards each of the plurality of head members 120 for a predetermined period of time in response to turning off the plurality of head members 120.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A customizable cleaning brush, comprising:

a main body;

a plurality of head members removably connected to at least a portion of the main body to brush, scrub, and massage a body of a user, such that a first of the plurality of head members rotates and a second of the plurality of head members vibrates and moves differently from the first of the plurality of head members;

a plurality of operation controls disposed on at least a portion of a first side of the main body to perform at least one of a rotation, oscillation, and vibration of the plurality of head members; and a plurality of pressure controls disposed on at least a portion of a second side of the main body to perform at least one of a speed control and a pressure control of the plurality of head members.

2. The customizable cleaning brush of claim 1, wherein each of the plurality of head members is at least one of bristles, sponges, and massaging members.

3. The customizable cleaning brush of claim 1, further comprising:

a handle disposed on at least a portion of a first end of the main body to facilitate gripping thereof.

4. The customizable cleaning brush of claim 3, wherein the handle extends telescopically and at least partially deforms.

5. The customizable cleaning brush of claim 3, further comprising:

an eject button disposed on at least a portion of a second end of the main body to extract the plurality of head members in response to depressing the eject button.

6. The customizable cleaning brush of claim 1, further comprising:

an air dispersion unit disposed on at least a portion of the main body to blow air towards each of the plurality of head members for a predetermined period of time in response to turning off the plurality of head members.

7. A customizable cleaning brush, comprising:

a main body comprising a plurality of member receiving portions;

a plurality of head members removably connected to at least one of the plurality of member receiving portions to brush, scrub, and massage a body of a user, such that a first of the plurality of head members moves at a first speed and a second of the plurality of head members moves at a second speed different from the first speed;

a plurality of operation controls disposed on at least a portion of a first side of the main body to perform at least one of a rotation, oscillation, and vibration of the plurality of head members; and a plurality of pressure controls disposed on at least a portion of a second side of the main body to perform at least one of a speed control and a pressure control of the plurality of head members.

* * * * *